US009054433B2

(12) United States Patent
Corbett et al.

(10) Patent No.: US 9,054,433 B2
(45) **Date of Patent: *Jun. 9, 2015**

(54) JUNCTION BOX FITTING FOR MARINE CABLES

(71) Applicant: The United States of America as represented by the Secretary of the Navy, Washington, DC (US)

(72) Inventors: Blaise L. Corbett, King George, VA (US); David J. Griffiths, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/263,467

(22) Filed: Apr. 28, 2014

(65) Prior Publication Data

US 2014/0235077 A1 Aug. 21, 2014

Related U.S. Application Data

(63) Continuation-in-part of application No. 14/051,385, filed on Oct. 10, 2013, now Pat. No. 8,747,126, which is a continuation-in-part of application No. 13/385,470, filed on Jan. 26, 2012, now Pat. No. 8,562,361.

(60) Provisional application No. 61/628,298, filed on Oct. 11, 2011.

(51) Int. Cl.

| | |
|---|---|
| ***H01R 13/648*** | (2006.01) |
| ***H01R 4/26*** | (2006.01) |
| ***H01R 4/50*** | (2006.01) |
| ***H01R 4/64*** | (2006.01) |
| *H01R 13/533* | (2006.01) |
| *H01R 13/6592* | (2011.01) |

(52) U.S. Cl.

CPC ..... *H01R 4/26* (2013.01); *H01R 4/5025* (2013.01); *H01R 4/643* (2013.01); *H01R 13/533* (2013.01); *H01R 13/6592* (2013.01)

(58) Field of Classification Search

CPC ..... H01R 4/643; H01R 13/2442
USPC ..... 439/100, 862, 860, 868, 883, 609, 578, 439/389, 92

See application file for complete search history.

(56) References Cited

U.S. PATENT DOCUMENTS

| | | | | |
|---|---|---|---|---|
| 4,515,991 | A * | 5/1985 | Hutchison | 174/654 |
| 4,687,263 | A * | 8/1987 | Cosmos et al. | 439/108 |
| 6,406,330 | B2 * | 6/2002 | Bruce | 439/607.19 |
| 6,468,100 | B1 * | 10/2002 | Meyer et al. | 439/320 |
| 8,747,126 | B2 * | 6/2014 | Corbett et al. | 439/98 |

* cited by examiner

*Primary Examiner* — Phuongchi T Nguyen
(74) *Attorney, Agent, or Firm* — Gerhard W. Thielman

(57) ABSTRACT

An electrical conduit ground assembly is provided for electrically and environmentally shielding an electric cable that inserts into a junction box via a through-hole. The assembly includes an adapter flange, first and second annular gaskets, first and second annular washers, a slip-ring, a ground adapter, first and second lock-nuts and a gland nut. The adapter flange has an internally threaded proximate end, an externally threaded mezzanine, a hexagonal seat, and an externally threaded distal end insertable into the through-hole. The first annular gasket inserts into the proximate end. The first and second washers insert into the proximate end. The annular ground adapter electrically connects the cable and the annular conduit between the first and second washers. The second annular gasket has an annular shaft and a circular brim. The gland nut screws into the proximate end of the adapter flange.

7 Claims, 3 Drawing Sheets

JUNCTION BOX FITTING FOR MARINE CABLES

CROSS REFERENCE TO RELATED APPLICATION

The invention is a Continuation-in-Part, claims priority to and incorporates by reference in its entirety U.S. patent application Ser. No. 14/051,385 filed Oct. 10, 2013, released as Publication 2014/0041938 and assigned Navy Case 102763, which is a Continuation-in-Part of U.S. patent application Ser. No. 13/385,470 filed Jan. 26, 2012, issued as U.S. Pat. No. 8,562,361 and assigned Navy Case 101421, which claims the benefit of priority, pursuant to 35 U.S.C. §119, the benefit of priority from provisional application 61/628,298, with a filing date of Oct. 11, 2011.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to fittings for electrical cable ground adapters, especially those used aboard marine vessels and platforms. In particular, the invention relates to embodiments for a flange connector to a junction box.

The United States Navy currently provides electromagnetic (EM) shielding from coupling to topside (i.e., above-deck) cables. Such cables can be inserted into a junction box for environmental protection and interconnection with electrical components.

SUMMARY

Conventional electrical ground adapters yield disadvantages addressed by various exemplary embodiments of the present invention. In particular, various exemplary embodiments provide an electrical grounding adapter within a conduit sealing assembly for electrically and environmentally shielding an electric cable. Various exemplary embodiments provide an electrical conduit ground assembly for electrically and environmentally shielding an electric cable that inserts into a junction box via a through-hole. The exemplary assembly includes an adapter flange, first and second annular gaskets, first and second annular washers, a slip-ring, a ground adapter, first and second lock-nuts and a gland nut. The adapter flange has an internally threaded proximate end, an externally threaded mezzanine, a hexagonal seat, and an externally threaded distal end insertable into the through-hole.

In various exemplary embodiments, the first annular gasket inserts into the proximate end and includes frustum and cylinder portions. The first annular washer inserts into the proximate end and disposal on the first gasket. The slip-ring inserts into the proximate end and disposal on the first washer. The second annular washer inserts into the proximate end and disposal on the slip-ring. The annular ground adapter electrically connects the cable and the annular conduit and inserts between the first and second washers and securable by the slip-ring with the cable installed in the junction box. The second annular gasket has an annular shaft and a circular brim that radially extends from a brim end that faces the second annular washer.

The gland nut screws into the proximate end of the adapter flange, the gland nut having a hexagonal proximate end and an externally threaded distal end. The annular shaft of the second annular gasket inserts into the gland nut from the threaded distal end. The first lock-nut screws onto the mezzanine and abut the landing, whereas the second lock-nut screws onto the distal end of the adapter flange.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Conduits for these cables can employ an exemplary cable shield ground adapter (CSGA) conduit to achieve grounding effectiveness exceeding 80 decibels (dB) while facilitating expedient replacement, in contrast to conventional shielding configurations. The background section of parent U.S. Pat. No. 8,562,361 includes further details about the conventional configurations. The exemplary CSGA can be used in a swage stuffing tube, or within an exemplary fitting that connects to a junction box.

Swage tubes, as military part M24235/17, have several standard sizes as listed at http://www.shipboardelectrical-.com/swagetubes.html including a tube body, gland nut and gland ring. The tube body can be stainless steel or aluminum. For purposes of disclosure, sizes B, C, D and K are described herein, although the principles described herein can be extended to additional cable sizes. Respective cable bore diameters for sizes B, C, D and K are Ø0.515 inch ("), Ø0.640", Ø0.750" and Ø1.171 inches ("). MIL-S-24235/2C provides the military standard dimensions for electrical cable packaging, available at http://dornequipment.com/milspecs/pdf/24235-2C.pdf.

Figure 1A:
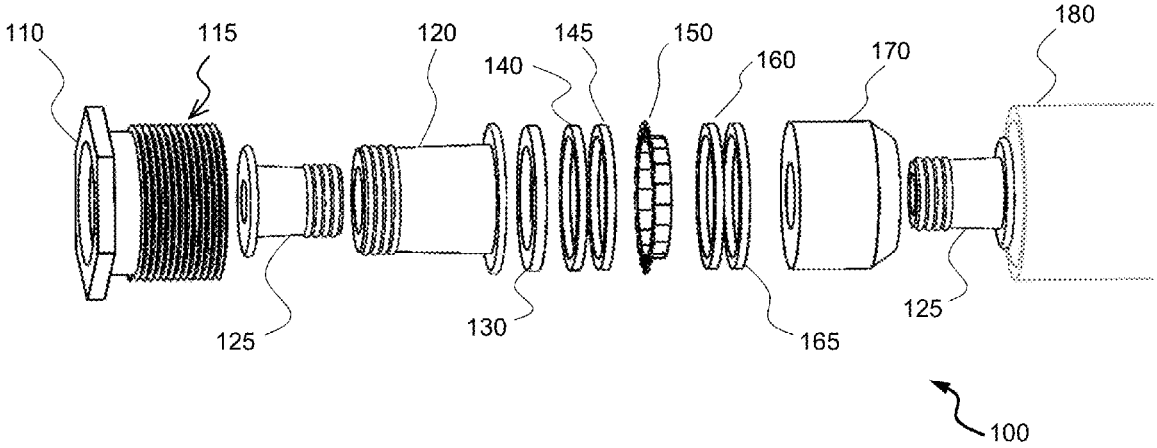
FIGS. 1A and 1B are respectively exploded and assembly perspective views of a swage tube ground adapter assembly.
Figure 1B:
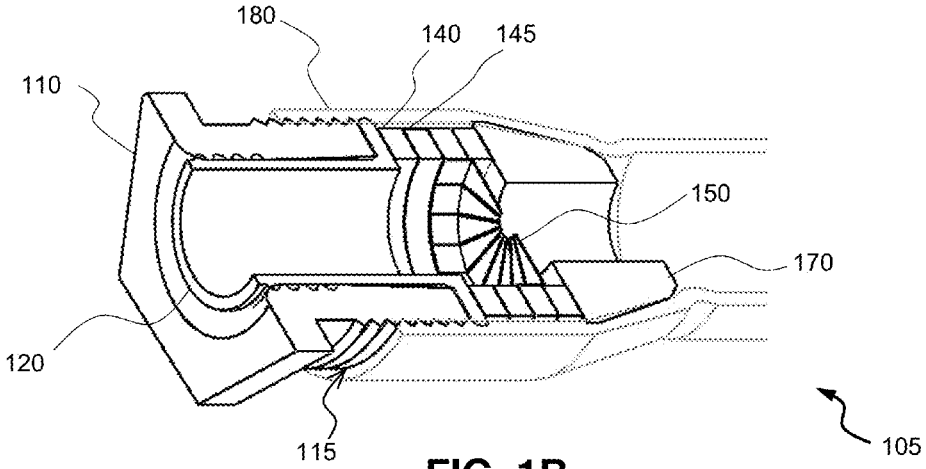

FIGS. 1A and 1B respectively show perspective exploded and cutaway assembly views 100 and 105 of exemplary swage tube components. A gland boss or nut 110 presents an annular access and includes outer threads 115 for installation. The gland nut 110 is typically composed of brass or aluminum and includes a hexagonal proximate end and an externally threaded distal end. A stuffing upper gasket or seal 120 and an optional insert upper gasket 125 provide an environmental seal for the stuffing tube interior for the access at the gland nut 110.

A gland ring 130 constitutes a shim or spacer between the upper gasket 120 and other components in the swage tube 180. The views 100 and 105 show orientation from upstream at the left to downstream at the right in the direction for inserting a cable to be shielded and grounded. An upper pair of slip rings 140 and 145 provides axial restraint between a CSGA diaphragm 150, and the gland ring 130. A lower pair of slip rings 160 and 165 provides axial restraint between the CSGA diaphragm 150 and a lower gasket or seal 170. Another optional insert upper gasket 125, together with the lower gasket 170, provide an environmental seal for the stuffing tube interior of a swage tube 180, into which the components can be inserted.

The insert upper gaskets 125 enable a large size swage tube 180 to accept a thinner cable and maintain environmental integrity, thereby expanding installation flexibility. The upper gaskets 120 and 125 have a geometric configuration reminiscent of a top-hat or stove-hat. The lower gasket 170 has a geometric configuration approximating a frustum (e.g., truncated cone). The gaskets 120, 125 and 170 provide environmental seals for the CSGA in the swage tube and are composed of rubber, with various sizes disclosed in Publication 2014/0041938.

For purposes of grounding, a "stetson" or "porkpie" design for the CSGA diaphragm 150 is incorporated herein, which can be produced as a metal ribbon or strip with a repeating pattern, cut to length, the tabs bent inward or outward, and the ends joined together to wrap around an electrical cable to be grounded. Publication 2014/0041938 illustrates deployable and flat strip views respectively in FIGS. 13 and 14 of the stetson configuration. The tube adapter assembly includes for the swage tube 180 the CSGA diaphragm 150 to protect a cable, but also the fittings, e.g., the gland nut 110, spacer rings 140 and 160, and gaskets 120 and 170 to provide environmental protection, especially salt-water spray contamination. An analogous adapter assembly for a junction box application similar to that provided for the swage tube is described herein.

Figure 2:
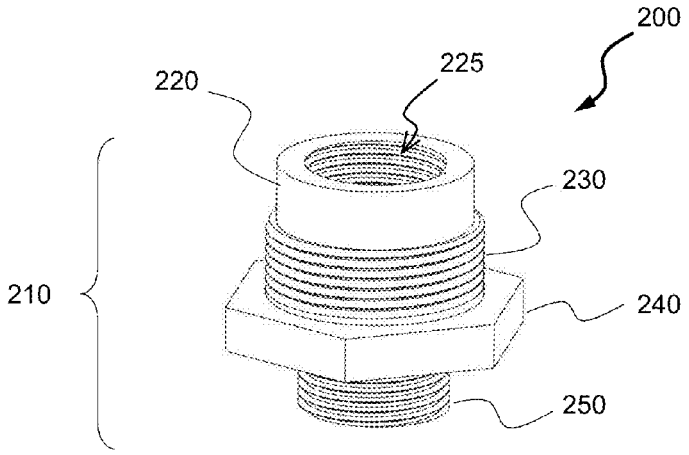
FIG. 2 is an exploded perspective view of junction box ground adapter components.

FIG. 2 illustrates a perspective view 200 of a junction box adapter flange 210. An upstream or proximate end 220 includes interior helical threads 225 at a mouth to receive the lower gasket 170. A threaded mezzanine segment 230 enables an upstream nut to secure the flange 210. A hexagonal landing 240 provides a mounting surface for the flange 210. The mezzanine 230 and landing 240 constitute a midsection of the flange 210. A downstream or distal end 250 includes external helical threads for a downstream nut. The flange 210 is typically composed of brass or aluminum.

Figure 3:
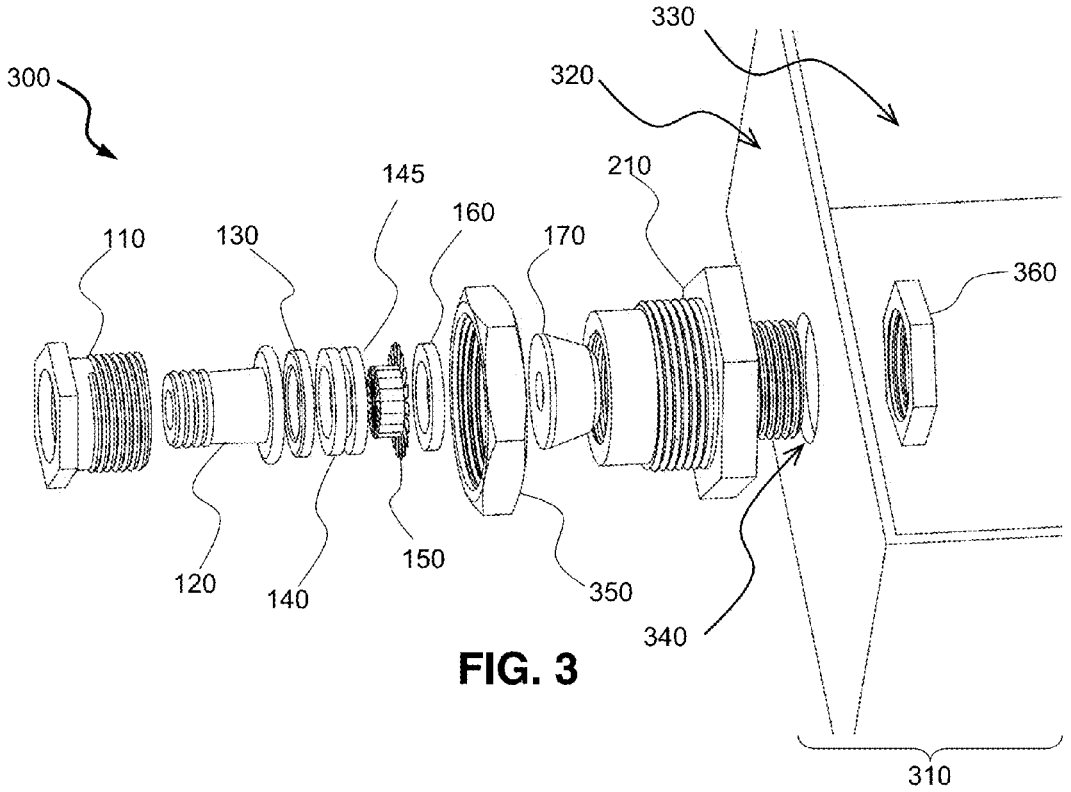
FIG. 3 is a cutaway elevation view of an exemplary junction box adapter assembly.

FIG. 3 shows an exploded perspective view 300 of a through adapter for a junction box 310 having an outer surface 320 and an inner surface 330 that defines an interior region. The adapter flange 210 connects to the junction box 310 from the outer surface 320 via a circular through-hole or opening 340 into which the downstream end 250 inserts. The lower gasket 170 inserts into the upstream end 220. The lower slip ring 160 provides axial restraint between the CSGA diaphragm 150 and the lower gasket 170.

The upper slip rings 140 and 145 provide axial restraint between the CSGA diaphragm 150, with the gland ring 130 separating these components from between the upper gasket 120. The gland nut 110 includes external threads 115 to engage the interior threads 225 of the flange 210. An upper lock nut 350 screws onto the mezzanine 230 to engage the landing 240. A lower lock nut 360 screws onto the downstream end 250 to secure the landing 240 to the inner surface 330.

Figure 4:
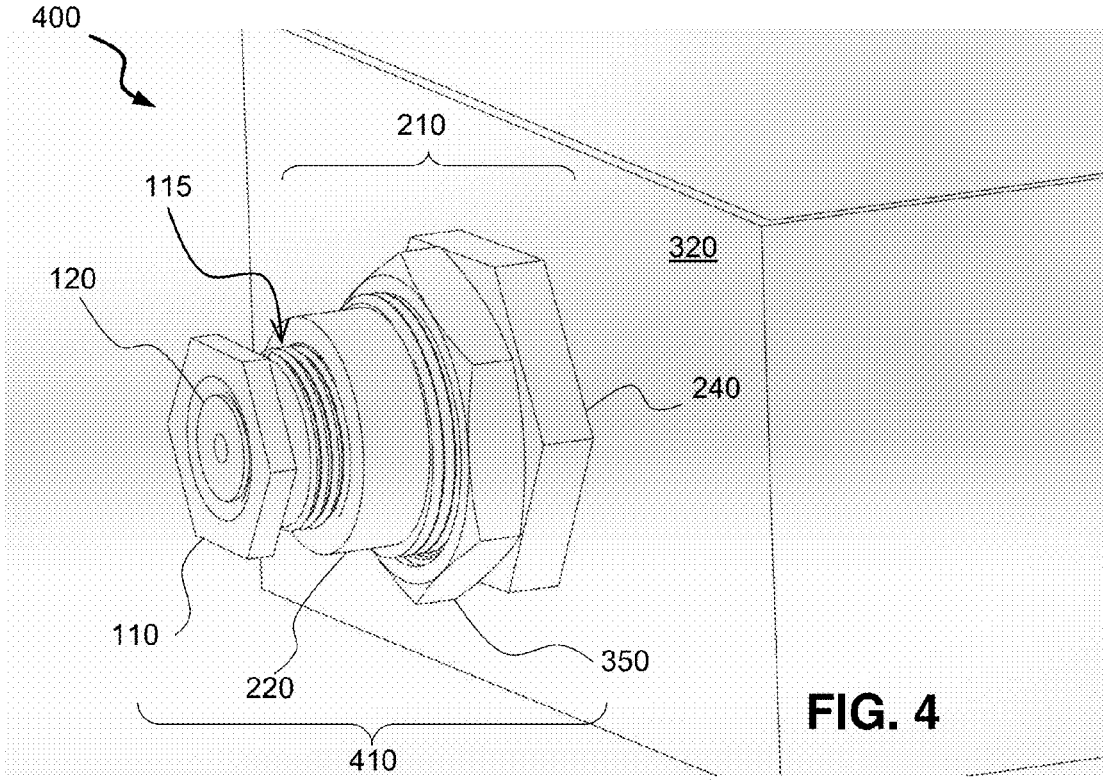
FIG. 4 is a perspective assembly view of a junction box adapter.

FIG. 4 shows an installation assembly perspective view 400 of the junction box through adapter assembly 410. The installation mounted to the junction box 310 features the landing 240 engaging the outer surface 320. The upper nut 350 abuts the landing 240 at its upstream side. The gland nut 110 with the upper gasket 120 that protrudes therefrom inserts into the upstream end 220 of the flange 210.

Figure 5:
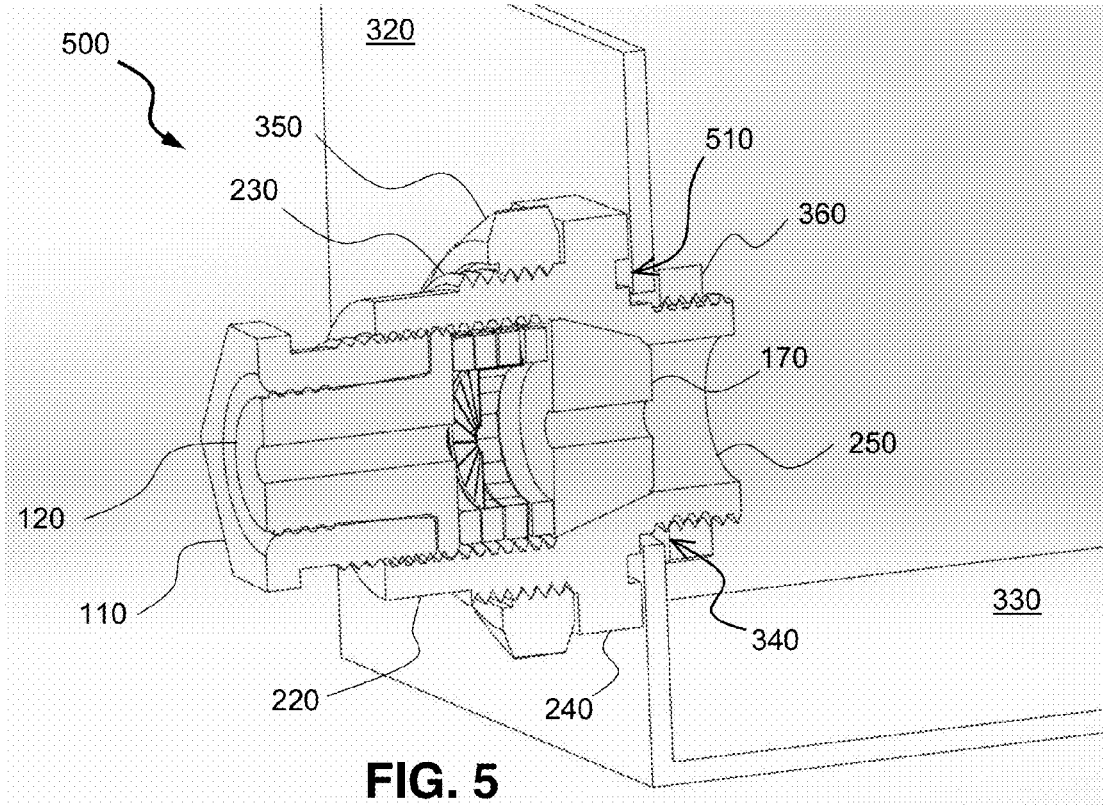
FIG. 5 is a perspective cutaway view of the junction box adapter.

FIG. 5 shows a cutaway perspective view 500 of the junction box through adapter assembly 410. The interior of the flange 210 at the landing 240 includes a tapering surface into which the lower gasket 170 inserts. The landing 240 includes an annular groove 510 facing the downstream end 250 for receiving an O-ring. The groove 510 is disposed on the surface of the flange 240 facing the outer surface 320 of the junction box 310. The groove 510 extends radially outward from the opening 340 through which the downstream end 250 extends. The CSGA diaphragm 150 and accompanying rings 140 and 150 are disposed within the mezzanine 230 of the flange 210 longitudinally sandwiched between the upper and lower gaskets 120 and 170.

The junction box through adapter assembly 410 described herein represents a modification of an analogous through adapter described in U.S. Pat. No. 8,562,361, particularly FIGS. 34-38. The modifications to the prior adapter enhance the utility of the adapter with respect to grounding cables and conduit installed in junction boxes composed of non-conductive composite or dielectric materials. The modified adapter retains the utility of the original design with respect to junction boxes made of metal, conductive materials or materials having a conductive coating.

The U.S. Navy is increasing the use of composite fixtures on combat vessels due to considerations of corrosion, weight and cost. While the composite materials have significant advantages in these three areas, the means of grounding the penetrations to these boxes is made more difficult. Metal fixtures can be grounded directly to a bulkhead or connected to the bulkhead via a conductive ground strap. Composite fixtures can conventionally ground a through connector in one of two ways: (1) via a ground strap attached to a grounding lug or bolt threaded into the body of the through adapter or (2) via an additional adapter component secured to the fixture into which the through adapter is inserted.

The additional component, i.e., the flange 210, provides a threaded sleeve through which the CSGA 150 may be inserted and the ground strap is secured between the two adapter components. This corresponds to stacking two of the through adapters as previously described with the exception that only a single gland nut 110 would be required. Although the configuration would be effective, its excessive weight and unnecessary cost present disadvantages.

The modification to the exemplary through adapter assembly 410 from the parent invention includes the addition of machine threading to a portion of the flange 210 of the through adapter as well as a lock-nut 350 with matching interior threads. The unthreaded surface could be of a smooth finish or knurled to enhance frictional grip. The external portion of the flange 210, which includes the upstream end 220, mezzanine 230 and the landing 240, is also referred to as the "upper portion" of the adapter assembly 410. The downstream end 250 of the adapter that typically resides inside the junction box 310 is referred to as the "lower portion" of the adapter assembly 410.

The upstream end 220 of the flange 210 is unthreaded to enhance component handling and installation by ship personnel. Threading of the full length can lead to unexpected hand injury during twisting. A threaded surface would also be problematic to grasping tools such as band wrenches, pipe wrenches and large pliers by likely damaging the threads and thereby compromising ability to either install or remove the lock-nut 350. The upstream end 220 of the flange 210 is also of smaller outside diameter than the threaded mezzanine 230 enabling easier application of the upper lock-nut 350. Preferably, this incorporates a National Pipe Straight (NPS) or National Pipe Taper (NPT) thread for the exterior threading on the external adapter portion as well as the exterior threading on the lower portion.

The associated upper and lower lock-nuts 350 and 360 employ the same NPS or NPT threading. The adoption of NPS or NPT thread facilitates broader use of the less expensive commercially available lock-nuts. The interior would retain a Unified Screw (UN) or Unified Screw Fine (UNF) threading in order to maintain compatibility with standard stuffing tube gland nuts. Designation of this preferred threading does not preclude the use of other types of threading.

The purpose of the modification is to simplify the means of attaching a grounding strap or plate to the adapter while minimizing the need for additional components. The lower portion of the adapter assembly 410 is inserted into the junction box 310 or fixture with the adapter seat landing 240 flush against the fixture. After insertion into the through-hole 340, the lock-nut 350 is threaded onto the downstream end 250 to secure the through connector to the fixture wall. A flexible O-ring seal within the annular groove 510 can be provided between the landing 240 and the outer wall 320.

A grounding strap or plate with a grounding lug of sufficient radius is disposed over the upper portion of the adapter flange 210 and fits over the threading until being flush with the exposed portion of the landing 240. The lock-nut 350 is threaded onto the upper portion of the adapter to secure the grounding strap or plate to the adapter assembly 410. The other end of the grounding strap or plate is secured to a ship's bulkhead.

The commercial potential for the ground shield adapter described within broad and global in nature. The designs can be used for commercial as well as naval ship construction. Due to the inherent design tolerance for either SAE or metric dimensions for swage tubes 180, the exemplary design can be employed for both domestic and foreign ship construction. Although designed with maritime applications in consideration, the exemplary configurations described herein can also be extended for general construction practices where junction boxes, swage tubes or other breach type fittings might be required for facility cable penetrations that require EM grounding, stabilization, or weather sealing.

The U.S. Navy utilizes hundreds of topside components that require electrical power or signal connections to systems internal to the surface ship via cable. Because of the complex and system hostile electromagnetic (EM) environment the connecting cables must be protected from unwanted EM coupling to the signal or power cable. Thus, the cables can be protected from the EM environment by a conductive cable shield grounded via the CSGA assembly 410 to the ship's bulkhead.

Current CSGA technologies utilized by the Navy are difficult to manufacture due to machining, difficult to install, repair and replace due to design characteristics, have relatively short service life due to poor environmental design, and are very expensive (approximately $300 per unit in quantity). The Navy also currently purchases CSGAs assemblies in multiple sizes due to inability of conventional CSGA to adapt to multiple swage tube sizes or cable diameters, thereby significantly increasing acquisition, logistics and design costs. The strategic goal of the proposed design is to provide the Navy a cost efficient technology that can significantly reduce total ownership costs via acquisition maintenance and logistics across the fleet.

The exemplary embodiments incorporate relatively few parts. Common components include environmental seals that also perform as stabilizing structural components for cable centering and conductive spacers that perform diaphragm deformation control functions. The CSGA diaphragm 150 can employ a cut-stamped component of conductive sheeting to wrap around a cable. The exemplary adapter designs for the junction box 310 also utilize all components of the stuffing tube assembly, including the brass gland nut 110 conventionally unutilized for shielded cable applications.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An electrical conduit ground assembly for electrically and environmentally shielding an electric cable that inserts into a junction box via a through-hole, said assembly comprising:

an adapter flange having an internally threaded proximate end, a midsection, and an externally threaded distal end, said midsection having an externally threaded mezzanine and a hexagonal seat that radially extends beyond said mezzanine, said distal end being insertable into the through-hole;

a first annular gasket for insertion downstream into said proximate end, said first gasket having frustum and cylinder portions;

a first annular washer for insertion downstream into said proximate end and disposal on said first gasket;

a slip-ring for insertion downstream into said proximate end and disposal on said first washer;

a second annular washer for insertion downstream into said proximate end and disposal on said slip-ring;

an annular ground adapter for electrically connecting the cable and the annular conduit, said adapter being insertable between said first and second washers and securable by said slip-ring with the cable installed in the junction box;

a second annular gasket having an annular shaft and a circular brim that radially extends from a brim end that faces said second annular washer;

a gland nut for screwing into said proximate end of said adapter flange, said gland nut having a hexagonal proximate end and an externally threaded distal end, said annular shaft of said second annular gasket being insertable into said gland nut from said threaded distal end; and first and second lock-nuts, said first lock-nut for screwing onto said mezzanine and abut said landing, said second lock-nut for screwing onto said distal end of said adapter flange.

2. The assembly according to claim 1, further including an annular groove on said landing to receive an O-ring disposable between said landing and the junction box.

3. The assembly according to claim 1, wherein said adapter flange comprises one of brass and aluminum.

4. The assembly according to claim 1, wherein said adapter flange comprises:

an internally threaded proximate end, an externally threaded mezzanine, a hexagonal seat that radially extends beyond said mezzanine, and an externally threaded distal end insertable into the through-hole.

5. The flange according to claim 4, wherein said adapter flange comprises one of brass and aluminum.

6. The flange according to claim 4, wherein said mezzanine can receive a first threaded lock-nut, and said distal end can receive a second threaded lock-nut.

7. The flange according to claim 6, wherein said landing has proximate and distal sides, said proximate side facing said mezzanine; and said distal side including an annular groove to receive an O-ring disposable between said landing and the junction box.

* * * * *